US008596410B2

(12) United States Patent
Deymier et al.

(10) Patent No.: US 8,596,410 B2
(45) Date of Patent: Dec. 3, 2013

(54) SOLID-STATE ACOUSTIC METAMATERIAL AND METHOD OF USING SAME TO FOCUS SOUND

(75) Inventors: Pierre A. Deymier, Tucson, AZ (US); Jaim Bucay, Tucson, AZ (US); Bassam Merheb, Blaybel (LB)

(73) Assignee: The Board of Arizona Regents on Behalf of the University of Arizona, Tucson, AZ (US)

( * ) Notice: Subject to any disclaimer, the term of this patent is extended or adjusted under 35 U.S.C. 154(b) by 0 days.

(21) Appl. No.: 13/254,112

(22) PCT Filed: Mar. 2, 2010

(86) PCT No.: PCT/US2010/025909

§ 371 (c)(1),
(2), (4) Date: Sep. 22, 2011

(87) PCT Pub. No.: WO2010/101910

PCT Pub. Date: Sep. 10, 2010

(65) Prior Publication Data

US 2012/0000726 A1 Jan. 5, 2012

Related U.S. Application Data

(60) Provisional application No. 61/208,928, filed on Mar. 2, 2009, provisional application No. 61/175,149, filed on May 4, 2009.

(51) Int. Cl.
*G10K 11/26* (2006.01)

(52) U.S. Cl.
USPC ..... 181/176

(58) Field of Classification Search
USPC ..... 181/175, 176, 286
See application file for complete search history.

(56) References Cited

U.S. PATENT DOCUMENTS

| | | | | |
|---|---|---|---|---|
| 7,057,476 | B2 | 6/2006 | Hwu | |
| 7,249,653 | B2 * | 7/2007 | Sheng et al. | 181/290 |

(Continued)

FOREIGN PATENT DOCUMENTS

| | | | |
|---|---|---|---|
| CN | 1618879 | A | 5/2005 |
| CN | 101952882 | A | 1/2011 |
| WO | 2007084318 | A2 | 7/2007 |
| WO | 2008097495 | A1 | 8/2008 |
| WO | 2009085693 | A1 | 7/2009 |

OTHER PUBLICATIONS

Yang, Suxia; Page, J.H.; Liu, Zhengyou; Cowan, M.L.; Chan, C.T.; Sheng, Ping; "Focusing of Sound in a 3D Phononic Crystal"; Physical Review Letters; bearing dates of Jul. 9, 2004, Mar. 1, 2004, Jul. 7, 2004, and 2004; pp. 024301-1-024301-4; vol. 93, No. 2; The American Physical Society.*

Qiu Chunyin, Master's Theses Full-text Database, May 15, 20106; Layer Multiple-Scattering Theory and Application Designing fro Two-Dimensional Phononic Crystals (with English translation).

*Primary Examiner* — Jeremy Luks
(74) *Attorney, Agent, or Firm* — Blank Rome LLP

(57) ABSTRACT

A phonemic crystal is made of a first solid medium having a first density and a substantially periodic array of structures disposed in the first medium, the structures being made of a second solid medium having a second density different from the first density. The first medium has a speed of propagation of longitudinal sound waves and a speed of propagation of transverse sound waves, the speed of propagation of longitudinal sound waves being approximately that of a fluid, and the speed of the propagation of transverse sound waves being smaller than the speed of propagation of longitudinal sound waves.

18 Claims, 5 Drawing Sheets

(56) References Cited

U.S. PATENT DOCUMENTS

2005/0070801 A1 3/2005 Yamashita et al.
2010/0009120 A1* 1/2010 Boyce et al. ..... 428/134
2011/0000741 A1* 1/2011 Berker et al. ..... 181/296
2011/0005859 A1* 1/2011 Berker et al. ..... 181/224
2011/0100746 A1* 5/2011 Berker et al. ..... 181/286

* cited by examiner

SOLID-STATE ACOUSTIC METAMATERIAL AND METHOD OF USING SAME TO FOCUS SOUND

REFERENCE TO RELATED APPLICATIONS

The present application claims the benefit of U.S. Provisional Application Nos. 61/208,928, filed Mar. 2, 2009, and 61/175,149, filed May 4, 2009, whose disclosures are hereby incorporated by reference in their entireties into the present disclosure.

FIELD OF THE INVENTION

The present invention is directed to an acoustic metamaterial and more particularly to an acoustic metamaterial having a solid-solid phononic crystal. The present invention is further directed to a method of using such a metamaterial to focus sound.

DESCRIPTION OF RELATED ART

Sukhovich et al, "Experimental and theoretical evidence for subwavelength imaging in phononic crystals," Physical Review Letters 102, 154301 (2009), which is hereby incorporated by reference in its entirety into the present disclosure, discloses a phononic crystal exhibiting negative refraction for use in a flat lens to achieve super-resolution. The phononic crystal includes a triangular lattice of stainless steel rods in a space filled with methanol. When surrounded by water, the phononic crystal exhibits an effective refractive index of −1 at a frequency of 550 kHz.

However, the use of the fluid reduces the practicality of that phononic crystal in terms of manufacturing and use.

In a separate field of endeavor, a solid phononic crystal for sound deadening is disclosed in PCT International Patent Application No. PCT/US2008/086823, published on Jul. 9, 2009, as WO 2009/085693 A1, whose disclosure is hereby incorporated by reference in its entirety into the present disclosure. However, that phononic crystal is adapted to perform a function, namely, sound deadening, which is wholly different from that with which the present invention is concerned. To achieve that function, the phononic crystal disclosed in that application comprises a first medium (rubber) having a first density and a substantially periodic array of structures disposed in the first medium, the structures being made of a second medium (air) having a second density different from the first density.

SUMMARY OF THE INVENTION

It is therefore an object of the invention to provide a more practical solution than that provided by the Sukhovich et al article.

To achieve the above and other objects, the present invention is directed to a phononic crystal in which the fluid of the above-cited Sukhovich et al reference is replaced by a solid material whose longitudinal speed of sound ($C_l$) approaches that of a fluid (e.g., 1500 m/sec for water) and whose transverse speed of sound ($C_t$) is smaller than the longitudinal speed of sound (e.g., less than 100 m/sec). Such a solid material behaves like a fluid because its transverse speed of sound is much lower than its longitudinal speed of sound. An example of such a solid material is organic or inorganic rubber. Being made only of solid components, this type of solid metamaterial is a more practical solution for numerous applications. The inclusions can be cylindrical (with any shape for the cross section) to form so-called 2D phononic structures or could be spheres (cubes or any other shapes) for making 3D solid/solid metamaterials. The tunability of frequency at which metamaterials behave as desired is done by controlling the properties of the constitutive materials as well as the size and geometry of the phononic crystal.

In what follows below, we show that a 2D rubber-steel metamaterial can exhibit negative refraction and subwavelength resolution (superlensing).

BRIEF DESCRIPTION OF THE DRAWINGS

A preferred embodiment of the present invention will be set forth in detail with reference to the drawings, in which.

DETAILED DESCRIPTION OF THE PREFERRED-EMBODIMENT

A preferred embodiment of the present invention will be set forth in detail with reference to the drawings.

We simulate the behavior of the steel rubber lens at 520 kHz. All geometrical parameters are the same as in the Sukhovich et al paper. The only difference is that the methanol (fluid) is replaced by rubber (solid) with $C_l$=1200 m/s and $C_t$=20 m/s. There is no viscoelasticity for now. The sound source is the same as that of Sukhovich et al and is located on the left of the lens.

Figure 1:
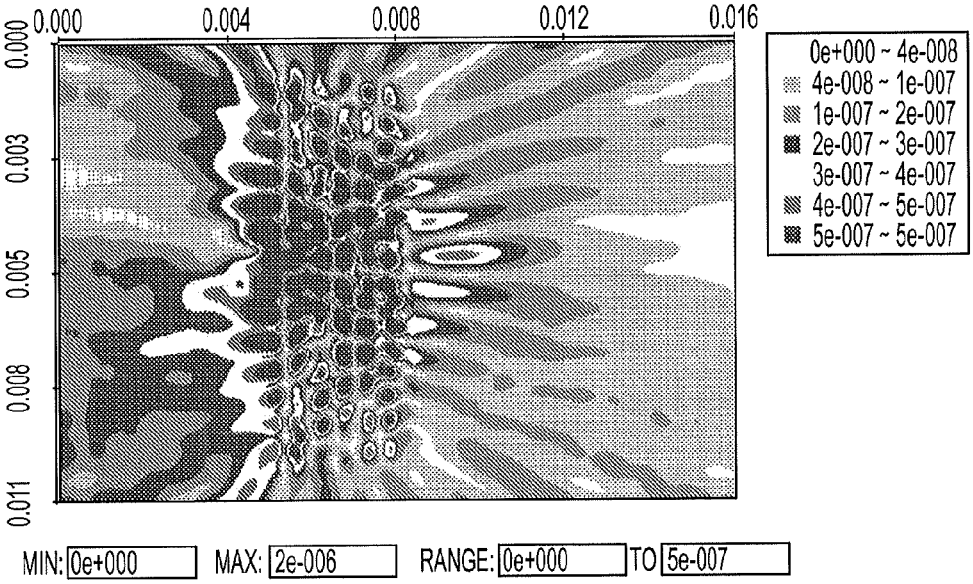
FIG. 1 is a plot showing the absolute value of pressure, averaged over one period.

In FIG. 1, we report the absolute value of the pressure, averaged over one period. The image spot is on the right on the lens. FIG. 1 shows that the rubber/steel lens exhibits the phenomenon of negative refraction leading to an image of the source.

Figure 2:
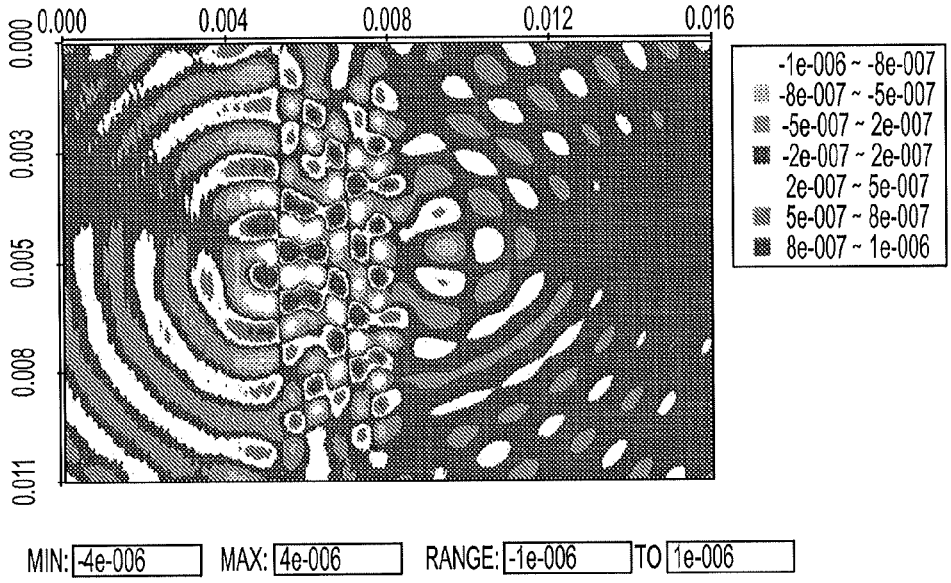
FIG. 2 is a plot showing the instantaneous pressure field.
Figure 3:
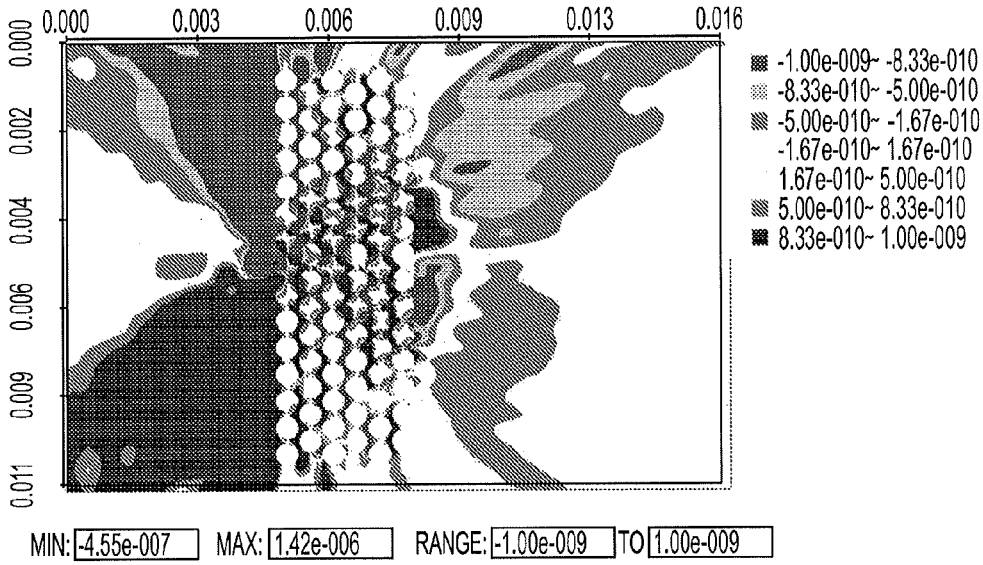
FIG. 3 is a plot showing the vertical component of energy flux.

The instantaneous pressure field is reported in FIG. 2 and shows the nearly spherical wave that is emitted by the source and by the image as well. We see the same focusing in FIG. 3 where we plot the vertical component of the energy flux. Note that the horizontal component of the energy flux always points from the left to the right (not illustrated here). One can see that there is a change in direction of the waves once inside the crystal. On the exit there is again a change in direction, both corresponding to a negative refraction. On the exiting side of the crystal there is a crossing of these beams, leading to the formation of the image. With this new solid/solid metamaterial, we obtain features which were previously only seen in fluid/solid systems.

Figure 4:
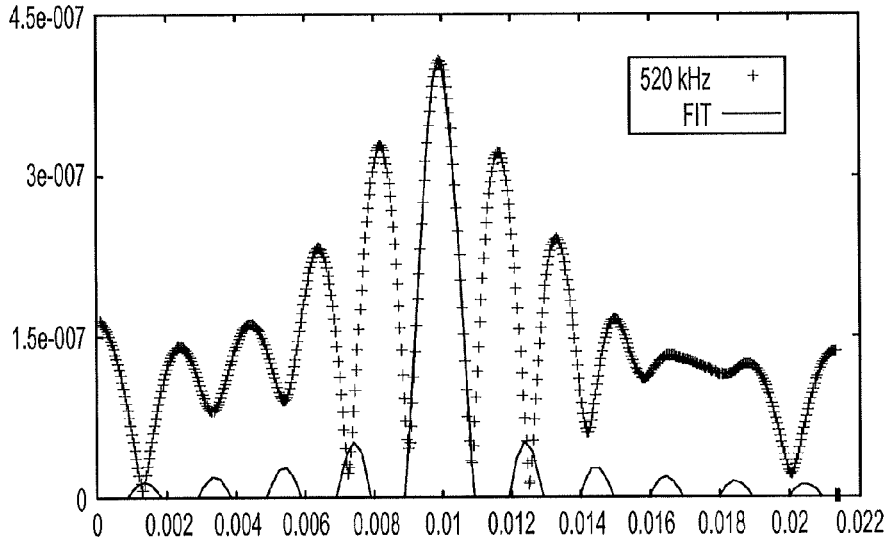
FIG. 4 is a plot showing a vertical cut through the image.

A vertical cut (parallel to the surface of the lens) through the image reveals a half width of the image which is smaller than the wavelength of the signal in water, $\lambda$ (as shown in FIG. 4). We have calculated the half width of the image spot to be 0.347 $\lambda$ (as compared to 0.5 $\lambda$ if the resolution limit of a lens were reached). The vertical axis measures intensity of pressure. The horizontal axis is a measure of length (m). The lower curve is a fit to a Sinc function. The width of the first peak along the horizontal axis is calculated to be 2 mm.

Figure 5A:
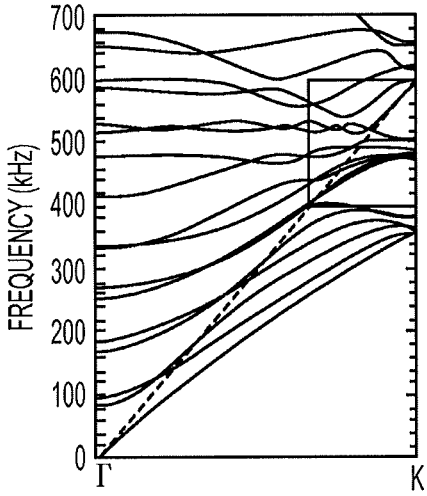
FIGS. 5A-5C are plots showing bound modes.
Figure 5B:
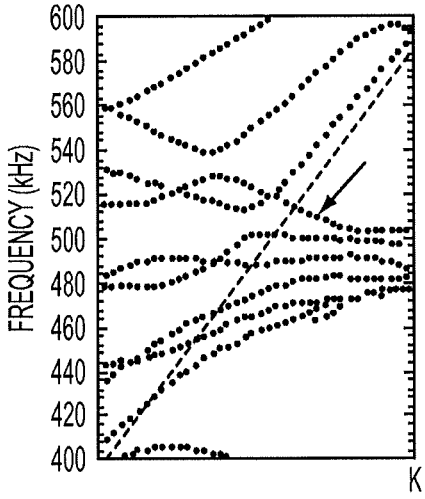
Figure 5C:
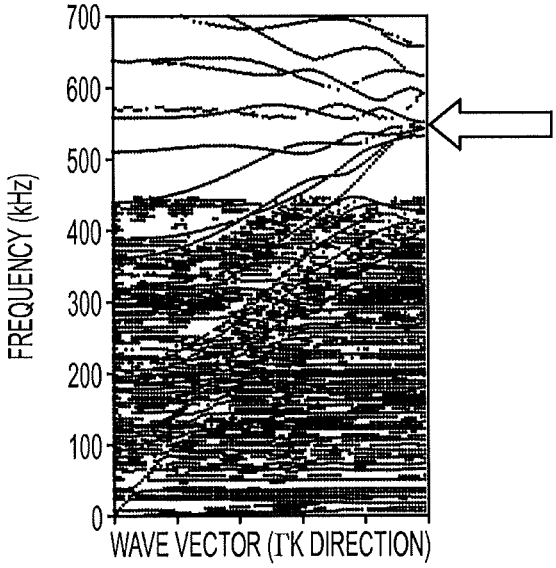

We confirm the existence of slab (lens) bound modes in the rubber/steel system that lead subwavelength imaging. (see FIGS. 5A-5C). The band structure of a methanol/steel phononic crystal in water is shown in FIGS. 5A and 5B (see paper by Sukhovich et al). FIG. 5C is the same as FIG. 5A, but for a rubber/steel crystal immersed in water. The arrow points at the slab bound mode that when excited can give rise to subwavelength imaging.

We therefore show that rubber with a $C_t << C_l$ behaves like a fluid. The transverse bands of the rubber all fall below the characteristic longitudinal bands that lead to negative refraction and subwavelength imaging.

Figure 6:
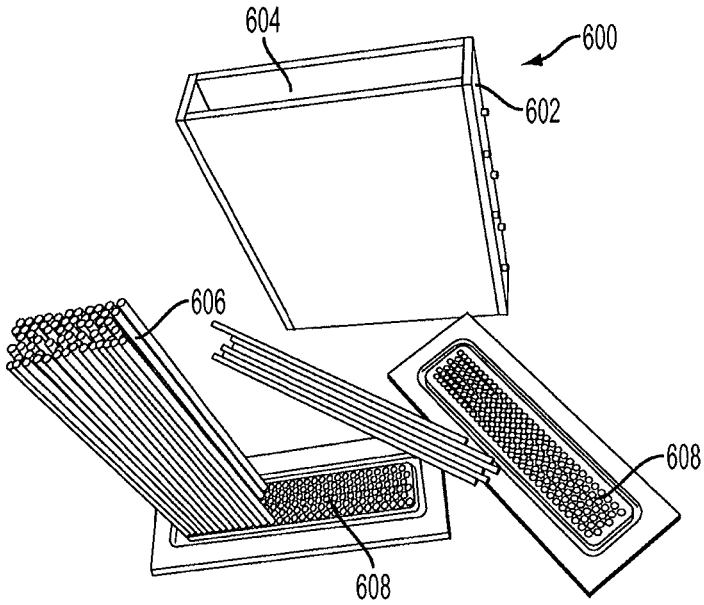
FIG. 6 is a photograph showing construction of a phononic crystal.

We are in the process of manufacturing a rubber/steel phononic crystal lens for testing, shown in FIG. 6 as 600. The steel box 602 is used to mold the rubber 604 inside the periodic array of steel rods 606, which are held in place by end plates 608.

Potential applications include the following.

(a) Holographic imaging of tissue with phononic metamaterials films

Non-invasive imaging techniques, such as ultrasound, are relied upon by the medical community for both diagnosis and treatment of numerous conditions. Therefore, improvements in non-invasive imaging techniques result in better health care for patients. A potential application is the use of acoustic metamaterial films for imaging the mechanical contrast in organs and tissues. This is an ultrasonic approach that can provide measurements of tissues and organs in any dimension. This technique would complement current imaging techniques such as Doppler ultrasound, which evaluates blood pressure and flow, and Magnetic Resonance Imaging (MRI). Holographic imaging with phononic metamaterials has a variety of applications including detecting changes in blood vessel diameter due to clots or damage, measuring arterial stenosis and determining organ enlargement (hypertrophy or hyperplasia) or diminishment (hypotrophy, atrophy, hypoplasia or dystrophy). The basic concept of this application would be to design a membrane composed of acoustic metamaterials that upon contact with a tissue and immersion in water can create a detectable holographic image in the water. The mechanical contrast in the tissue can be reconstructed by creating a sound grid raster image via a piezoelectric or photoacoustic probe in the water. The use of several acoustic metamaterial films, which can image the tissue at various wavelengths (i.e. length scales), can be used to construct a multi-resolution composite image of the tissue through multi-scale signal compounding methods.

Figure 7:
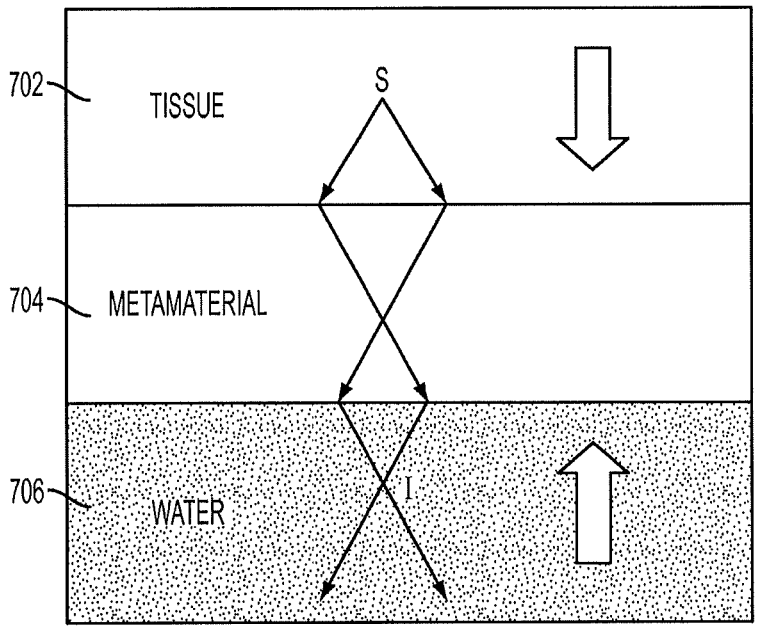
FIG. 7 is a schematic diagram showing a holograph acoustic imaging system.

The concept is illustrated in FIG. 7. The primary or secondary sound source S in a tissue is imaged through a metamaterial 702 to form an image/in an easily probed medium 706 (e.g., water). The narrow arrows show the path of acoustic waves refracted negatively. The broad arrows feature some object of interest imaged by the film and illustrate the shape inversion of the object and image.

(b) Acoustic metamaterials for making invisibility cloaks for submarines and other navy applications.

(c) Applications to industrial process such as megasonic cleaning in microelectronic industry. The acoustic metamaterials can focus sound to maximize cleaning locally.

(d) Applications to non-destructive testing, etc.

(e) Other applications: sound insulation, etc.

While a preferred embodiment has been set forth in detail above, those skilled in the art who have reviewed the present disclosure will readily appreciate that other embodiments can be realized within the scope of the present invention. For example, recitations of specific numerical values and materials are illustrative rather than limiting, as are recitations of specific uses. Therefore, the present invention should be construed as limited only by the appended claims.

We claim:

1. A phononic crystal comprising:

a first solid medium having a first density; and a substantially periodic array of structures disposed in the first medium, the structures being made of a second solid medium having a second density different from the first density;

wherein the first medium has a speed of propagation of longitudinal sound waves and a speed of propagation of transverse sound waves, the speed of propagation of longitudinal sound waves being equal to that of a fluid, and the speed of the propagation of transverse sound waves being smaller than the speed of propagation of longitudinal sound waves, and wherein the substantially periodic array of structures is configured such that the phononic crystal acts as a lens for focusing sound.

2. The phononic crystal of claim 1, wherein the structures are cylindrical.

3. The phononic crystal of claim 2. wherein the structures form a two-dimensional phononic structure.

4. The phononic crystal of claim 1, wherein the first solid medium comprises rubber.

5. The phononic crystal of claim 4, wherein the second solid medium comprises steel.

6. The phononic crystal of claim 1, wherein the structures form a phononic structure in at least two dimensions.

7. A method for focusing sound, the method comprising:

(a) providing a phononic crystal comprising:

a first solid medium having a first density; and a substantially periodic array of structures disposed in the first medium, the structures being made of a second solid medium having a second density different from the first density;

wherein the first medium has a speed of propagation of longitudinal sound waves and a speed of propagation of transverse sound waves, the speed of propagation of longitudinal sound waves being equal to that of a fluid, and the speed of the propagation of transverse sound waves being smaller than the speed of propagation of longitudinal sound waves;

(b) disposing the phononic crystal in a path of the sound to be focused; and (c) focusing the sound using the phononic crystal.

8. The method of claim 7, wherein the phononic crystal has a negative index of refraction at a wavelength of the sound to be focused.

9. The method of claim 7, wherein the phononic crystal exhibits superlensing at a wavelength of the sound to be focused.

10. The method of claim 7, wherein the sound focused by the phononic crystal is used in imaging.

11. The method of claim 10, wherein the imaging is non-invasive imaging.

12. The method of claim 11, wherein step (c) comprises focusing the sound into a third medium to form an image.

13. The method of claim 12, wherein the third medium comprises water.

14. The method of claim 7, wherein the structures are cylindrical.

15. The method of claim 14, wherein the structures form a two-dimensional phononic structure.

16. The method of claim 7, wherein the first solid medium comprises rubber.

17. The method of claim 16, wherein the second solid medium comprises steel.

18. The method of claim 7, wherein the structures form a phononic structure in at least two dimensions.

* * * * *